US011497954B2

(12) United States Patent
Washington

(10) Patent No.: US 11,497,954 B2
(45) Date of Patent: Nov. 15, 2022

(54) EXERCISING APPARATUS

(71) Applicant: Valdemar L. Washington, Flint, MI (US)

(72) Inventor: Valdemar L. Washington, Flint, MI (US)

( * ) Notice: Subject to any disclaimer, the term of this patent is extended or adjusted under 35 U.S.C. 154(b) by 0 days.

(21) Appl. No.: 17/316,074

(22) Filed: May 10, 2021

(65) Prior Publication Data

US 2022/0161086 A1 May 26, 2022

Related U.S. Application Data

(63) Continuation-in-part of application No. 16/420,236, filed on May 23, 2019, now Pat. No. 11,000,438.

(51) Int. Cl.
*A63B 21/00* (2006.01)
*A63B 22/00* (2006.01)
(Continued)

(52) U.S. Cl.
CPC .... *A63B 21/00196* (2013.01); *A63B 21/0058* (2013.01); *A63B 21/4015* (2015.10);
(Continued)

(58) Field of Classification Search
CPC ..... A63B 21/159; A63B 21/4011; A63B 21/4013; A63B 21/4015; A63B 21/4023; A63B 21/4025; A63B 21/4034; A63B 21/0004; A63B 21/00178; A63B 21/00189; A63B 21/04; A63B 21/045; A63B 7/146; A63B 23/04; A63B 23/02; A63B 23/0254; A63B 24/0003; A63B 24/0087; A63C 9/003; A63C 9/16; A63C 10/14; A63C 10/285; A61H 1/00; A61H 1/005;
(Continued)

(56) References Cited

U.S. PATENT DOCUMENTS 4,063,753 A * 12/1977 Cordeiro ..... A63C 9/002 280/637
4,258,910 A 3/1981 Carter
(Continued)

FOREIGN PATENT DOCUMENTS

JP 2001258975 A 9/2001
JP 2009219576 A 10/2009
(Continued)

OTHER PUBLICATIONS

International Search Report regarding International Application No. PCT/US2020/033975, dated Sep. 9, 2020.
(Continued)

*Primary Examiner* — Megan Anderson
(74) *Attorney, Agent, or Firm* — Harness, Dickey & Pierce, P.L.C.

(57) ABSTRACT

Systems and methods for an exercise apparatus are provided and include a flexible elongated member, a binding apparatus, and a motor assembly. The binding apparatus is attached to the flexible elongated member and has a clamping mechanism configured to secure a shoe of a user of the exercise apparatus to the flexible elongated member. The motor assembly is disposed between the shoe and the flexible elongated member and is configured to cause the flexible elongated member to oscillate.

24 Claims, 14 Drawing Sheets

(51) Int. Cl.
*A63B 21/005* (2006.01)
*A63B 24/00* (2006.01)
*A63B 71/06* (2006.01)

(52) U.S. Cl.
CPC ..... *A63B 21/4043* (2015.10); *A63B 22/0012* (2013.01); *A63B 24/0087* (2013.01); *A63B 2071/0675* (2013.01); *A63B 2208/0233* (2013.01)

(58) Field of Classification Search
CPC ..... A61H 1/0237; A61H 1/0266; A61H 2023/0281; A61H 2023/0263; A61H 2201/0157; A61H 2201/1207; A61H 2201/1215; A61H 2201/1261; A61H 2201/1269; A61H 2201/164; A61H 2203/0425; A61H 2203/0431; A61H 2203/0462; A61H 2205/12
See application file for complete search history.

(56) References Cited

U.S. PATENT DOCUMENTS

| | | | | |
|---|---|---|---|---|
| 5,147,262 | A | 9/1992 | Hymanson | |
| 5,184,989 | A | 2/1993 | Stanec | |
| 5,722,919 | A | 3/1998 | Timmer | |
| 8,439,854 | B2 | 5/2013 | Terrio | |
| 2010/0274163 | A1 | 10/2010 | Terrio | |
| 2012/0088640 | A1 | 4/2012 | Wissink et al. | |
| 2013/0053224 | A1 | 2/2013 | Dhanai | |
| 2013/0196828 | A1 | 8/2013 | Kaye | |
| 2018/0318639 | A1* | 11/2018 | Kim | A63B 22/0046 |

FOREIGN PATENT DOCUMENTS

| | | | |
|---|---|---|---|
| KR | 200408764 | Y1 | 2/2006 |
| KR | 1020100085138 | A | 7/2010 |
| KR | 100991909 | B1 | 11/2010 |

OTHER PUBLICATIONS

Written Opinion of the International Searching Authority regarding International Application No. PCT/US2020/033975, dated Sep. 9, 2020.

International Preliminary Report on Patentability regarding International Application No. PCT/US2020/033975, dated Nov. 16, 2021.

International Search Report and Written Opinion regarding Patent Application No. PCT/US2022/027894, dated Aug. 26, 2022.

* cited by examiner

EXERCISING APPARATUS

CROSS-REFERENCE TO RELATED APPLICATIONS

This application is a continuation-in-part of U.S. patent application Ser. No. 16/420,236 filed on May 23, 2019. The entire disclosure of the above application is incorporated herein by reference.

FIELD

The present disclosure relates to an exercising apparatus.

BACKGROUND

This section provides background information related to the present disclosure and is not necessarily prior art.

Exercise apparatuses may be used to exercise various muscles of a person's body. Such exercise apparatuses may be difficult to use and expensive to manufacture. The exercise apparatus of the present disclosure is simple to use and inexpensive to manufacture. The exercise apparatus of the present disclosure also effectively exercises a person's body including the person's lower body portion (e.g., lower legs, upper legs, lower abdominal, etc.), for example.

SUMMARY

This section provides a general summary of the disclosure, and is not a comprehensive disclosure of its full scope or all of its features.

In one form, the present disclosure provides an exercise apparatus that includes a shoe, a flexible elongated member and a motor assembly. The flexible elongated member is attached to the shoe at one position of a plurality of positions. The motor assembly is disposed between the shoe and the elongated member. The motor assembly is configured to cause the elongated member to oscillate.

In some configurations of the exercise apparatus of the above paragraph, the elongated member is attached to the shoe at the one position such that the shoe and the elongated member extend parallel to each other.

In some configurations of the exercise apparatus of any one or more of the above paragraphs, the elongated member is attached to the shoe at the one position such that the shoe and the elongated member are angled relative to each other.

In some configurations of the exercise apparatus of any one or more of the above paragraphs, the motor assembly includes a motor and a plurality of vibration members connected to the motor. The vibration members are spaced apart from a top surface of the elongated member when the motor in an OFF mode.

In some configurations of the exercise apparatus of any one or more of the above paragraphs, the vibration members are configured to move up and down when the motor is turned to an ON mode, which causes the vibration members to impact the top surface of the elongated member such that the elongated member oscillates.

In another form, the present disclosure provides an exercise apparatus that includes an exercise device and a processor. The exercise device includes a shoe, a flexible elongated member and a motor assembly. The flexible elongated member is configured to be attached to the shoe at one position of a plurality of positions. The motor assembly is disposed between the shoe and the elongated member. The motor assembly includes a motor and vibration members connected to the motor. The vibration members are configured to impact the elongated member such that the elongated member oscillates. The processor is configured to execute instructions in a nontransitory computer-readable medium. The instructions include uploading a medical image, matching the medical image to a template medical image stored in the nontransitory computer-readable medium to obtain a treatment protocol, generating a notification indicating which one position of the plurality of positions to attach the flexible elongated member to the shoe, and starting the treatment protocol such that a signal is transmitted to the motor which causes the vibration members to impact the elongated member and oscillate the elongated member.

In some configurations of the exercise apparatus of the above paragraph, the signal transmitted to the motor causes the motor to turn to an ON mode for a predetermined duration and at a predetermined power.

In some configurations of the exercise apparatus of any one or more of the above paragraphs, the signal transmitted to the motor causes the motor to turn to an ON mode for a predetermined duration.

In some configurations of the exercise apparatus of any one or more of the above paragraphs, a power of the motor varies over the predetermined duration.

In some configurations of the exercise apparatus of any one or more of the above paragraphs, a power of the motor is adjustable.

In some configurations of the exercise apparatus of any one or more of the above paragraphs, a magnitude of the oscillations of the elongated member are greater when the power is increased and smaller when the power is decreased.

In some configurations of the exercise apparatus of any one or more of the above paragraphs, the vibration members impact the elongated member with a greater force when the power is increased and with a lesser force when the power is decreased.

In some configurations of the exercise apparatus of any one or more of the above paragraphs, the medical image is of a muscle of a lower body portion.

In yet another form, the present disclosure provides a method including uploading a medical image, matching the medical image to a template medical image stored in a nontransitory computer-readable medium to obtain a treatment protocol, generating a notification indicating which one position of a plurality of positions to attach a flexible elongated member of an exercise device to a shoe of the exercise device, and starting the treatment protocol such that a signal is transmitted to a motor of the exercise device which causes vibration members of the exercise device to impact the elongated member and oscillate the elongated member.

In some configurations of the method of the above paragraph, the signal transmitted to the motor causes the motor to turn to an ON mode for a predetermined duration and at a predetermined power.

In some configurations of the method of any one or more of the above paragraphs, the signal transmitted to the motor causes the motor to turn to an ON mode for a predetermined duration.

In some configurations of the method of any one or more of the above paragraphs, a power of the motor varies over the predetermined duration.

In some configurations of the method of any one or more of the above paragraphs, a power of the motor is adjustable.

In some configurations of the method of any one or more of the above paragraphs, a magnitude of the oscillations of the elongated member are greater when the power is increased and smaller when the power is decreased.

In some configurations of the method of any one or more of the above paragraphs, the vibration members impact the elongated member with a greater force when the power is increased and with a lesser force when the power is decreased.

In some configurations of the method of any one or more of the above paragraphs, the medical image is of a muscle of a lower body portion.

In yet another form, an exercise apparatus includes a flexible elongated member and a binding apparatus attached to the flexible elongated member and having at least one clamping mechanism configured to secure a shoe of a user of the exercise apparatus to the flexible elongated member. The exercise apparatus also includes a motor assembly disposed between the shoe and the flexible elongated member, the motor assembly configured to cause the flexible elongated member to oscillate.

In some configurations, the at least one clamping mechanism is pivotable between an open position to receive or release the shoe and a closed position to secure the shoe to the flexible elongated member.

In some configurations, the at least one clamping mechanism includes an actuator having a spring loaded actuation device configured to drive the at least one clamping mechanism between the open position and the closed position.

In some configurations, the at least one clamping mechanism includes an actuator having an electrical motor configured to drive the at least one clamping mechanism between the open position and the closed position.

In some configurations, the at least one clamping mechanism includes an actuator that drives the at least one clamping mechanism between the open and the closed position, the exercise apparatus further comprising an actuator trigger connected to the actuator, the actuator trigger being configured to trigger the actuator to drive the at least one clamping mechanism to the closed position.

In some configurations, the actuator trigger includes a mechanical button.

In some configurations, the actuator trigger includes a proximity sensor.

In some configurations, the at least one clamping mechanism includes an actuator that drives the at least one clamping mechanism between the open and the closed position, the exercise apparatus further comprising an release button connected to the actuator, the release button being configured to trigger the actuator to drive the at least one clamping mechanism to the open position.

In some configurations, the motor assembly includes a motor and a plurality of vibration members connected to the motor, and wherein the plurality of vibration members are spaced apart from a top surface of the flexible elongated member when the motor is in an OFF mode.

In some configurations, the plurality of vibration members are configured to move up and down when the motor is turned to an ON mode, which causes the plurality of vibration members to impact the top surface of the flexible elongated member such that the flexible elongated member oscillates.

In some configurations, the exercise apparatus further comprises an arm exercising device with poles configured to be moved back and forth by the user of the exercise apparatus.

In some configurations, the arm exercising device is configured to provide a resistance to movement of the poles back and forth by the user.

In yet another form, a method includes securing a shoe of a user of an exercise apparatus to a flexible elongated member with a binding apparatus attached to the flexible elongated member and having at least one clamping mechanism configured to secure the shoe of the user to the flexible elongated member. The method also includes oscillating the flexible elongated member with a motor assembly disposed between the shoe and the flexible elongated member.

In some configurations, the at least one clamping mechanism is pivotable between an open position to receive or release the shoe and a closed position to secure the shoe to the flexible elongated member.

In some configurations, the at least one clamping mechanism includes an actuator having a spring loaded actuation device configured to drive the at least one clamping mechanism between the open position and the closed position.

In some configurations, the at least one clamping mechanism includes an actuator having an electrical motor configured to drive the at least one clamping mechanism between the open position and the closed position.

In some configurations, the at least one clamping mechanism includes an actuator that drives the at least one clamping mechanism between the open and the closed position, the exercise apparatus further comprising an actuator trigger connected to the actuator, the actuator trigger being configured to trigger the actuator to drive the at least one clamping mechanism to the closed position.

In some configurations, the actuator trigger includes a mechanical button.

In some configurations, the actuator trigger includes a proximity sensor.

In some configurations, the at least one clamping mechanism includes an actuator that drives the at least one clamping mechanism between the open and the closed position, the exercise apparatus further comprising an release button connected to the actuator, the release button being configured to trigger the actuator to drive the at least one clamping mechanism to the open position.

In some configurations, the motor assembly includes a motor and a plurality of vibration members connected to the motor, and wherein the plurality of vibration members are spaced apart from a top surface of the flexible elongated member when the motor is in an OFF mode.

In some configurations, the plurality of vibration members are configured to move up and down when the motor is turned to an ON mode, which causes the plurality of vibration members to impact the top surface of the flexible elongated member such that the flexible elongated member oscillates.

In some configurations, the method further comprises moving an arm exercising device with poles back and forth.

In some configurations, the arm exercising device is configured to provide a resistance to movement of the poles back and forth by the user.

In yet another form, an exercise apparatus first and second flexible elongated members each configured for attachment to first and second shoes, respectively, of a user of the exercise apparatus. The exercise apparatus also includes first and second motor assemblies disposed between the first and second flexible elongated members and the first and second shoes, respectively, the first and second motor assemblies being configured to cause the first and second flexible elongated members to oscillate. The exercise apparatus also include first and second rotational drums attached to the first and second flexible elongated members, respectively, and configured to rotate the first and second flexible elongated members while the first and second flexible elongated members oscillate.

In some configurations, first and second poles are attached to the first and second rotational drums, respectively, and configured to be grasped by the user while the user is using the exercise apparatus.

In some configurations, third and fourth motor assemblies disposed within the first and second poles, respectively, and configured to cause the first and second poles to oscillate.

In some configurations, the first and second rotational drums are interlocked to rotate at the same rotational speed.

In some configurations, the first and second elongated members are attached to the first and second rotational drums, respectively, at location points that are 180° out of phase.

In some configurations, the first and second poles are attached to the first and second rotational drums, respectively, at location points that are 180° out of phase.

In some configurations, first and second binding apparatuses are attached to the first and second flexible elongated members, respectively, the first and second binding apparatuses each having at least one clamping mechanism configured to secure the first and second shoes to the first and second flexible elongated members, respectively.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1*a* is a perspective view of a person seated and wearing exercising devices of an exercising apparatus according to the principles of the present disclosure.

FIG. 1*b* is a perspective view of a person seated and wearing alternate exercising devices of an exercising apparatus.

Corresponding reference numerals indicate corresponding parts throughout the several views of the drawings.

DETAILED DESCRIPTION

Figure 1A:
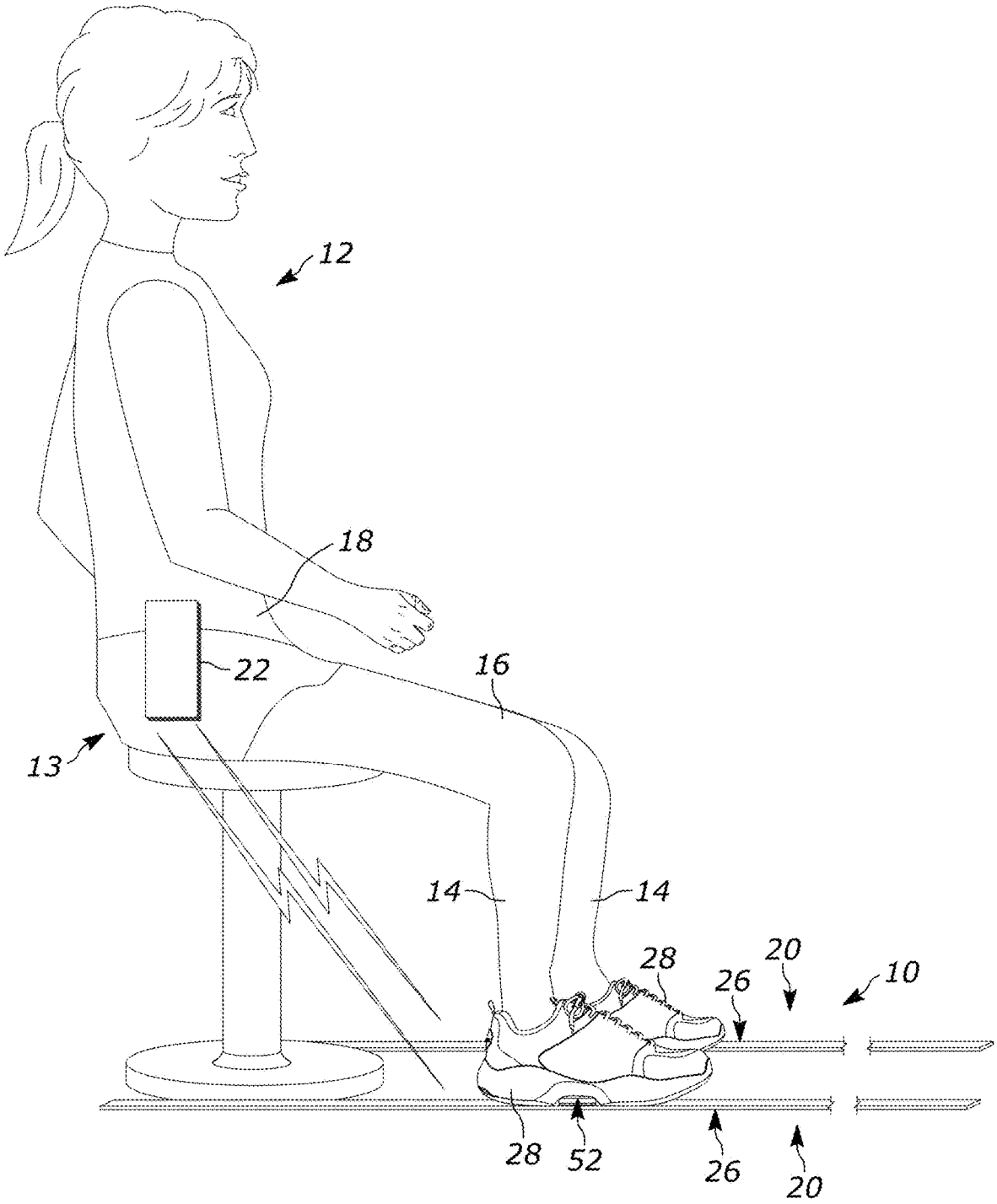
Figure 1B:
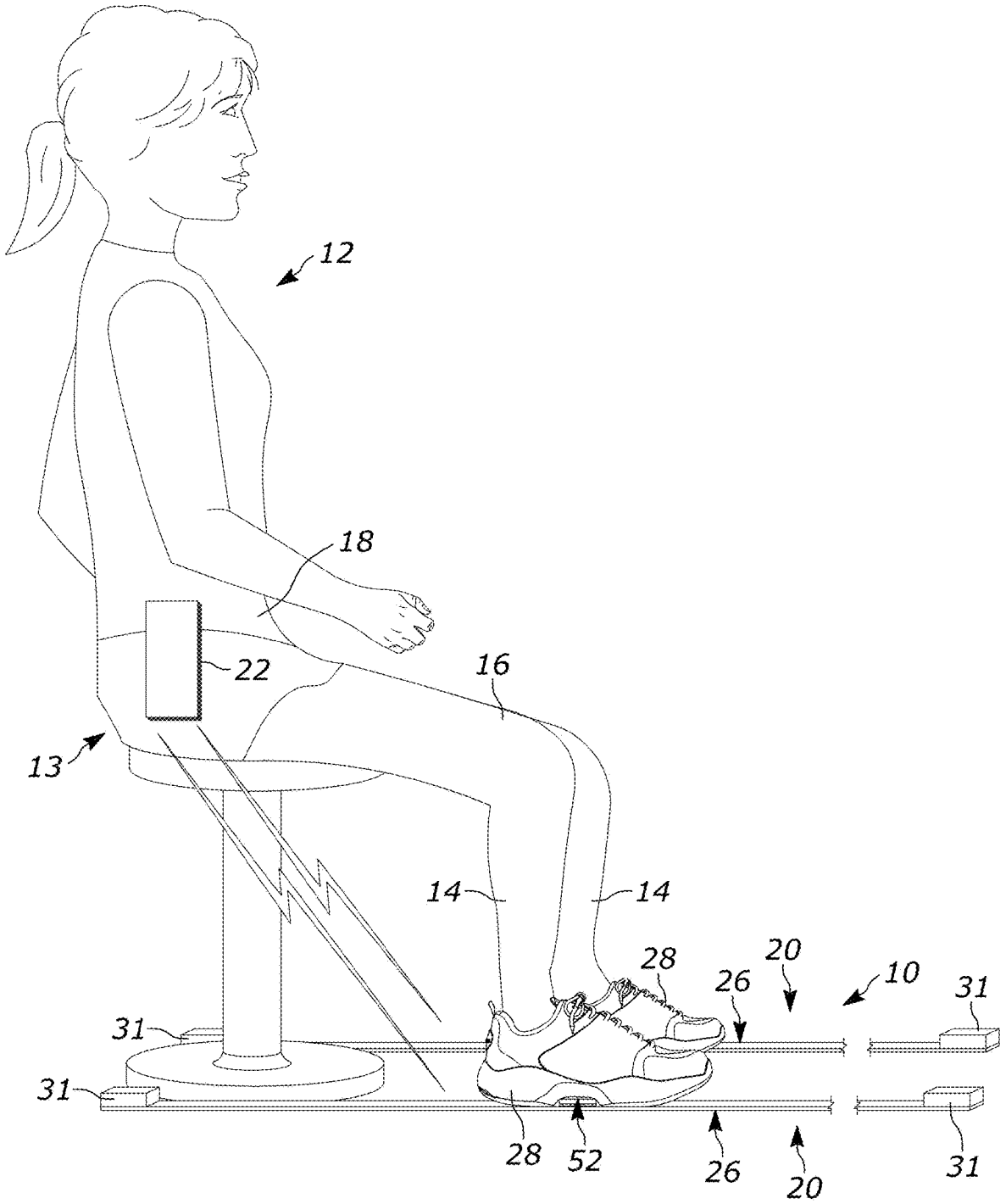
Figure 2:
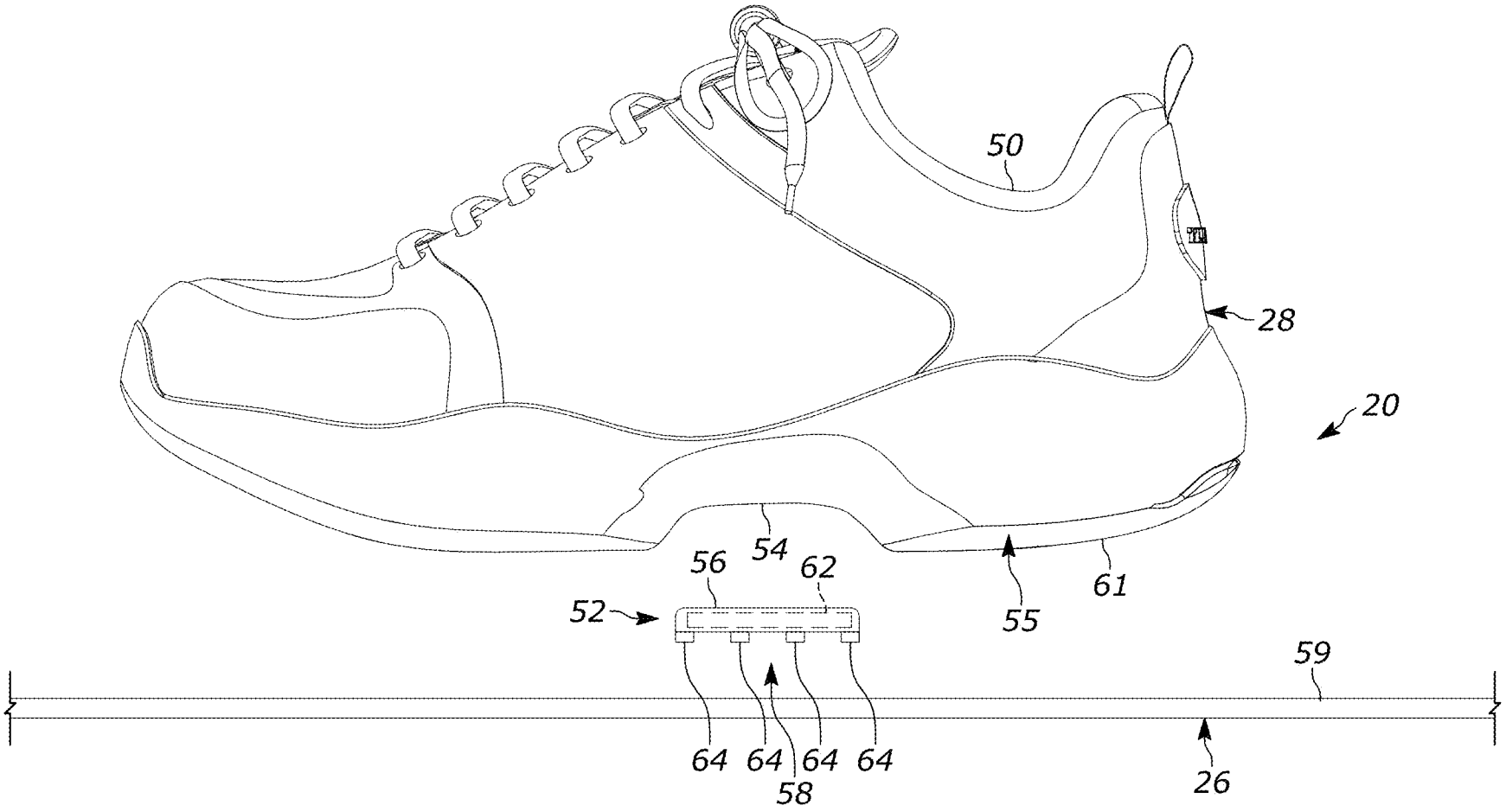
FIG. 2 is a an exploded view of one exercise device of the exercising apparatus in FIG. 1*a*.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As shown in FIG. 1*a*, an exercising apparatus 10 is provided. A user 12 may operate the exercising apparatus 10 to exercise. For example, the exercising apparatus 10 may be operated by the user 12 to exercise a lower body portion 13 of the user 12 such as their legs 11 (i.e. each leg 11 comprises a lower leg 14, an upper leg 16 and a foot 17) and a lower abdominal 18, for example. The exercising apparatus 10 may include a pair of exercise devices 20 and a computing device 22.

As shown in FIGS. 1-4 and 7, each exercise device 20 may be operable independently of each other and may include a flexible elongated member 26 and a shoe 28. The elongated member 26 may be flat and may include opposing ends. In some configurations, the elongated member 26 may be arcuate. In some configurations, the elongated member 26 may be telescoping such that the elongated member 26 may be conveniently packaged and transported. In some configurations, as shown in FIG. 1*b*, opposing ends 30 of each elongated member 26 may include weights 31 attached thereto to facilitate oscillations of the elongated member 26. The elongated member 26 may be removably attached to the shoe 28 at a middle portion of the elongated member 26 among a plurality of positions.

Figure 3:
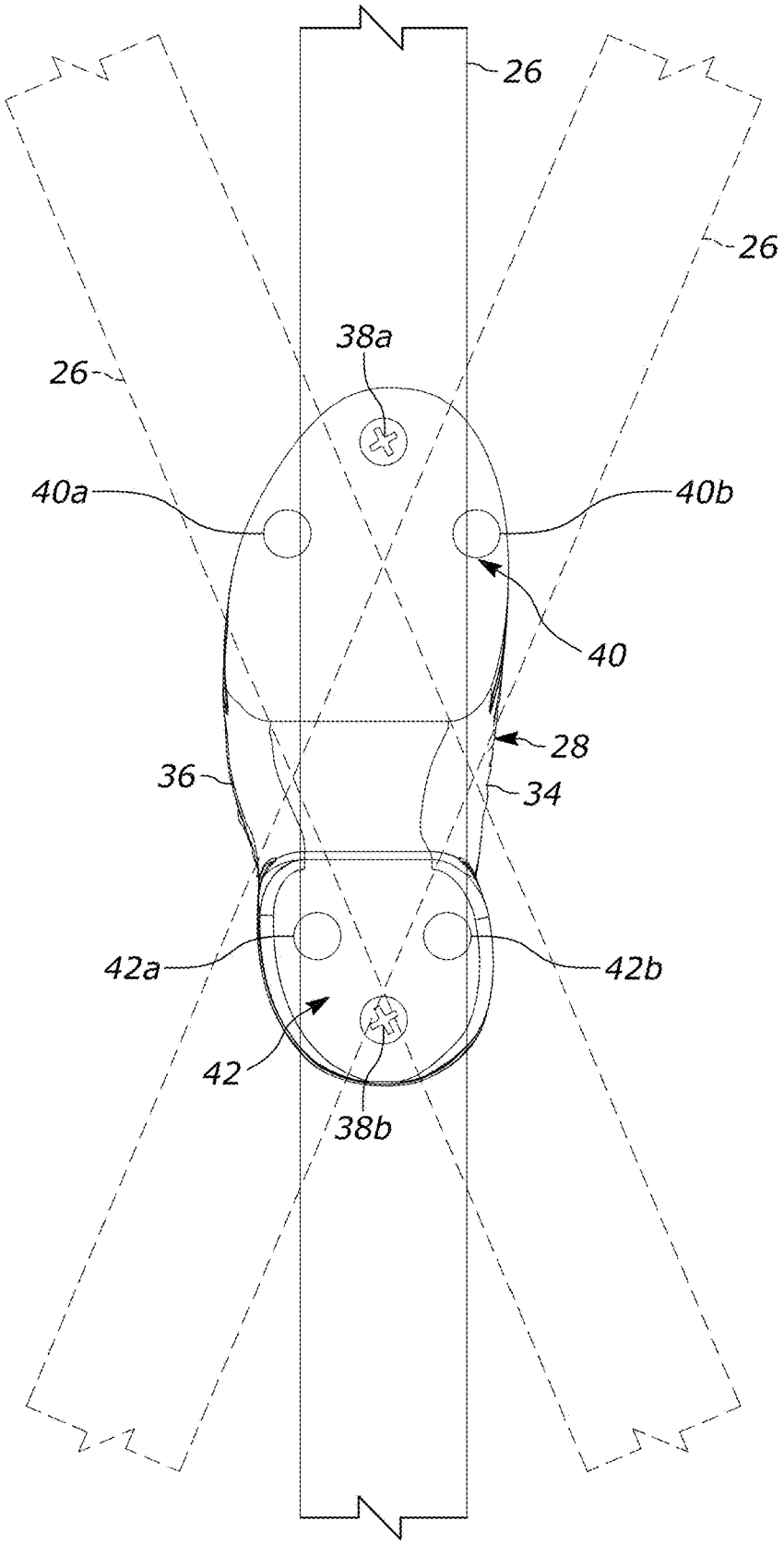
FIG. 3 is a bottom view of one exercise device of the exercising apparatus in FIG. 1*a*.

For example, as shown in FIG. 3, the elongated member 26 may be attached to the shoe 28 in a first position in which the elongated member 26 and the shoe 28 are parallel to each other (i.e., the shoe 28 extends in a direction parallel to a longitudinal axis of the elongated member 26). In another example, as shown in phantom lines in FIG. 3, the elongated member 26 may be attached to the shoe 28 in a second position in which the elongated member 26 is angled (i.e., non-parallel angle) relative to the shoe 28 (i.e., a portion of the elongated member 26 extends past an inward portion 34 of the shoe 28 at a front end thereof and another portion of the elongated member 26 extends past an outward portion 36 of the shoe 28 at a rear end thereof). It is understood that the inward portion 34 of the shoe 28 is opposite the outward portion 36 of the shoe 28 and the inward portion 34 of the shoe 28 faces an inward portion 34 of the other shoe 28. In another example, as shown in phantom lines in FIG. 3, the elongated member 26 may be attached to the shoe 28 in a third position in which the elongated member 26 is angled (i.e., non-parallel angle) relative to the shoe 28 (i.e., the portion of the elongated member 26 extends past the outward portion 36 of the shoe 28 at the front end thereof and the other portion of the elongated member 26 extends past the inward portion 34 of the shoe 28 at the rear end thereof). Each position that the elongated member 26 is attached to the shoe 28 targets a different area of the lower body portion 13.

As shown in FIG. 3, the elongated member 26 may be attached to the shoe 28 via fasteners 38*a*, 38*b* (e.g., bolts, screws, etc.). The shoe 28 may include a plurality of first apertures 40 (comprising aperture 40*a*, aperture 40*b* and aperture 40 (not shown)) at or near the front end of the shoe 28 and a plurality of second apertures 42 (comprising aperture 42*a*, aperture 42*b* and aperture 42 (not shown)) at or near the rear end of the shoe 28. The fastener 38*a* may extend through an aperture (not shown) of the elongated member 26 and one of the plurality of apertures 40 of the shoe 28 to attach the elongated member 26 to the shoe 28. Similarly, the fastener 38*b* may extend through an aperture (not shown) of the elongated member 26 and one of the plurality of apertures 42 of the shoe 28 to further attach the elongated member 26 to the shoe 28. It should be understood that the apertures 40, 42 and the apertures of the elongated member 26 may be threaded.

It should also be understood that although the elongated member 26 is attached to the shoe 28 via fasteners 38*a*, 38*b*, the elongated member 26 may be attached to the shoe 28 or foot of the user via attachment mechanisms or any other suitable means. For example, a locking plate (not shown) may be attached to the elongated member 26 among the plurality of positions. The shoe 28 may be secured to the locking plate via straps (not shown), for example, such that the shoe 28 is attached to the elongated member 26. A foot of the user 12 may be inserted into the shoe 28 (via an opening 50), thereby securing the foot of the user 12 to the shoe 28. The foot of the user 12 may also be attached directly to the elongated member 26 (i.e., without the shoe 28) via the locking plate or any other attachment mechanisms (e.g., straps).

Figure 4:
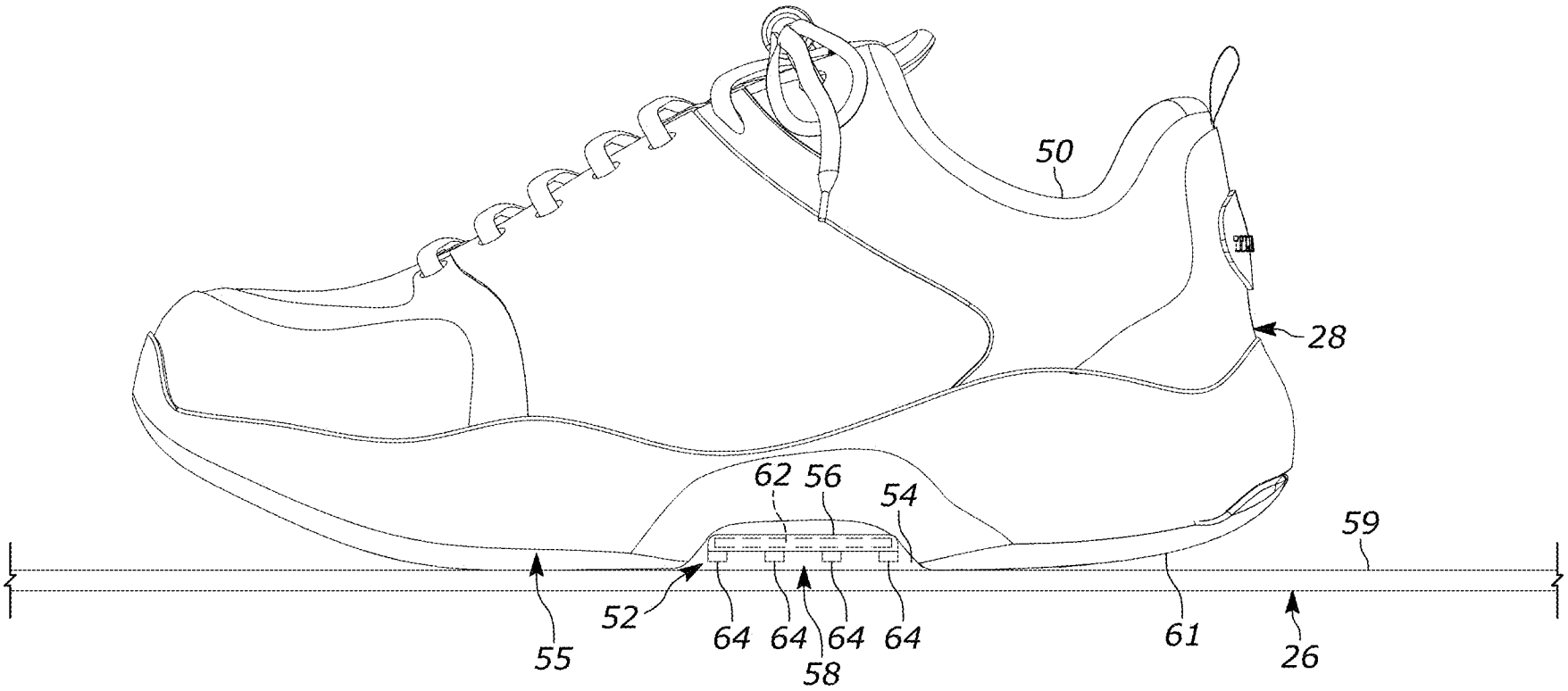
FIG. 4 is a cross-sectional view of the one exercise device.

As shown in FIG. 4, a motor assembly 52 may be disposed in a cavity 54 formed in a sole 55 of the shoe 28 and may include a motor casing 56 and a motor device 58. In some configurations, the motor assembly 52 may be attached to a top surface 59 of the elongated member 26 or a bottom surface 61 of the sole 55 of the shoe 28 via any suitable means (adhesives, fasteners, etc.). The motor casing 56 may be adjacent to the top surface 59 of the elongated member 26 (i.e., the motor casing 56 may contact the top surface 59 of the elongated member 26 or may be spaced apart from the top surface 59 of the elongated member 26). The motor casing 56 may also house the motor device 58. The motor device 58 may include a motor 62 and vibration members 64. The motor 62 may be a servo-motor, for example.

The vibration members 64 may be connected to the motor 62 such that a gap exists between ends of the vibration members 64 and the top surface 59 of the elongated member 26 when the motor 62 is in an OFF mode. The vibration members 64 are configured to move up and down when the motor 62 is turned to an ON mode. This causes the vibration members 64 to impact the top surface 59 of the elongated member 26 such that the elongated member 26 oscillates back and forth (FIG. 7; the ends of the elongated member 26 oscillate back and forth). Caps (not shown) made of natural rubber, synthetic rubber or any other suitable material may be disposed on the vibration members 64 to protect the elongated member 26 as the vibration members 64 repeatedly impact the elongated member 26. It is understood that the power of the motor 62 is adjustable. In this way, a magnitude of the oscillations of the elongated member 26 are greater when the power of the motor 62 is increased as opposed to when the power of the motor 62 is decreased. Stated another way, the vibration members 64 impact the elongated member 26 with a greater force when the power of the motor 62 is increased as opposed to when the power of the motor 62 is decreased, which, in turn, causes the magnitude of the oscillations of the elongated member 26 to be greater.

Figure 5:
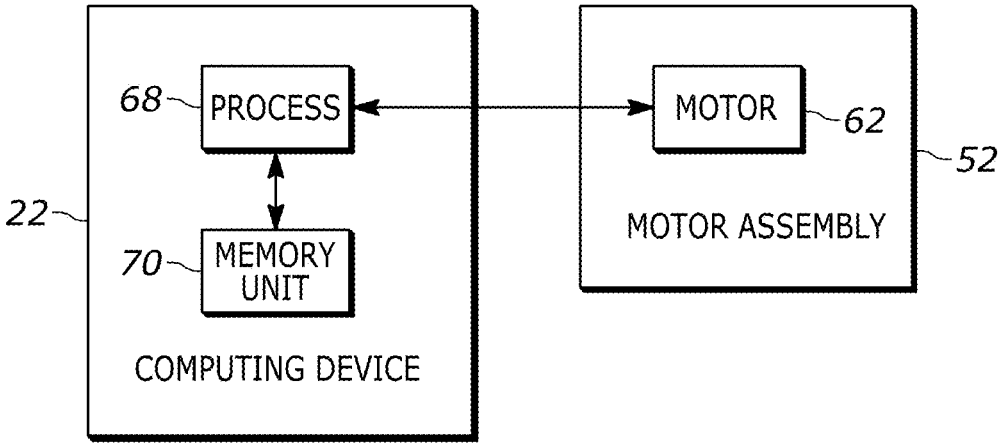
FIG. 5 is a block diagram illustrating communication between the exercise devices and the computing device.

As shown in FIG. 5, the computing device 22 may be in communication with the motors 62 of the motor assemblies 52 of the pair of exercise devices 20 and may include a processor 68 that is configured to execute instructions stored in a memory unit 70, which may be a nontransitory computer-readable medium, such as a random-access memory (RAM) and/or read-only memory (ROM). The computing device 22 could be a computer, a mobile phone (e.g., smartphone), or a tablet, for example, or any other communication device or network of devices. The computing device 22 may be in communication with the motors 62 via, for example, an internet, Wi-Fi, Bluetooth®, Zigbee®, power-line carrier communication (PLCC), or cellular connection or any other wired or wireless communication protocol. The user 12 may upload his or her medical image (e.g., ultrasound image, magnetic resonance imaging (MRI), etc.) provided by his or her physician to the computing device 22. The medical image may be of the lower body portion 13 of the user 12, for example. For example, the medical image may be an MRI of the lower leg muscles of the user 12. In another example, the medical image may be an MRI of the upper leg muscles of the user 12.

The memory unit 70 may store template images therein. The template images may be medical images (e.g., ultrasound images, magnetic resonance imaging (MRI), etc.) of muscles, for example, in predetermined conditions (e.g., mild muscle strain, severe muscle contusion). Each template image may be associated with a treatment protocol. For example, a template image of a lower leg muscle that has a mild strain may be associated with one treatment protocol. In another example, a template image of a lower adnominal muscle that has a mild strain may be associated with another treatment protocol.

The processor 68 may communicate with the memory unit 70 to match the uploaded image to a corresponding template image stored in the memory unit 70. Once the uploaded image is matched to the corresponding template image, the treatment protocol associated with the template image is obtained. Based on the treatment protocol, the computing device 22 may notify the user 12 of the shoe 28 to put on (i.e., left shoe or right shoe) and a position in which the elongated member 26 should be attached to the shoe 28 that the user 12 has on. Once the user 12 puts on the shoe 28 and attaches the elongated member 26 to the shoe 28 that the user 12 has on, the user 12 may select a control on the computing device 22 to start the treatment protocol, which, in turn, transmits a signal to the motor 62 to turn the motor 62 to the ON mode. Based on the treatment protocol, the signal transmitted to the motor 62 causes the motor 62 to turn ON for a predetermined duration and at a predetermined power. It should be understood that, in some configurations, based on the treatment protocol, the signal transmitted to the motor 62 causes the power of the motor 62 to vary over the course of the predetermined duration. For example, if the motor 62 is to run for a predetermined duration of 10 minutes, the motor 62 may operate at a first power for 5 minutes and a second power for 5 minutes.

It should be understood that, in some configurations, the memory unit 70 may be remote (e.g., in a cloud baser server) and may store template images therein. In such configurations, the computing device 22 may communicate with the remote memory unit 70 such that the uploaded image may be matched to a corresponding template image stored in the memory unit 70 and the treatment protocol associated with the corresponding template image is obtained.

It should also be understood that in the event that the uploaded image does not match any of the template images stored in the memory unit 70, a custom treatment protocol will be created for that uploaded image based on the template images stored in the memory unit 70. For example, if the uploaded image is close to two template images that are stored in the memory unit 70, the custom treatment protocol may be a combination of the treatment protocols that are associated with the two template images.

Figure 8:
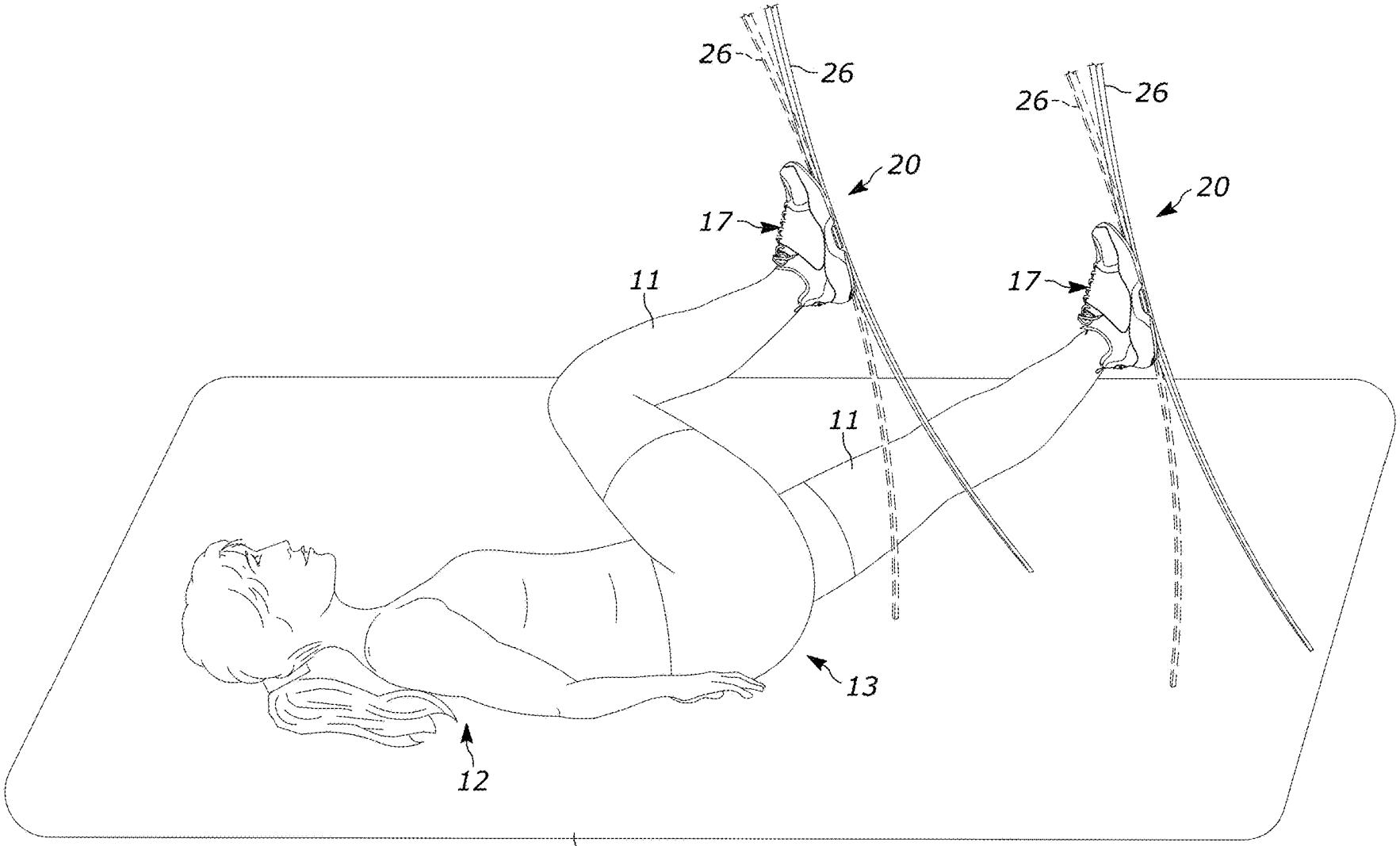
FIG. 8 is a perspective view of the person laying on their back and wearing the exercising devices and both elongated members of the exercising devices oscillating.

In some configurations, as shown in FIG. 8, the user 12 may lie on their back 80 with each leg 11 raised above a ground surface 84 (i.e., each leg 11 is suspended in the air and off the ground surface 84). At this point, while the vibration members 64 of each exercise device 20 are causing the respective elongated member 26 to oscillate, the user 12 may alternate the movement of their legs 11 back-in-fourth to further rehabilitate and/or exercise their lower body portion 13. In some configurations, when the motor 62 is in the OFF mode and one of the legs 11 is fully extended, the user 12 may move the foot 17 associated with the extended leg 11 back-in-fourth, thereby causing the elongated member 26 secured to the foot 17 to oscillate as oppose to the vibration members 64 oscillating the elongated member 26. In some configurations, the user 12 may move only one leg 11 back-in-fourth as oppose to alternating the movement of both legs 11 back-in-fourth.

Figure 6:
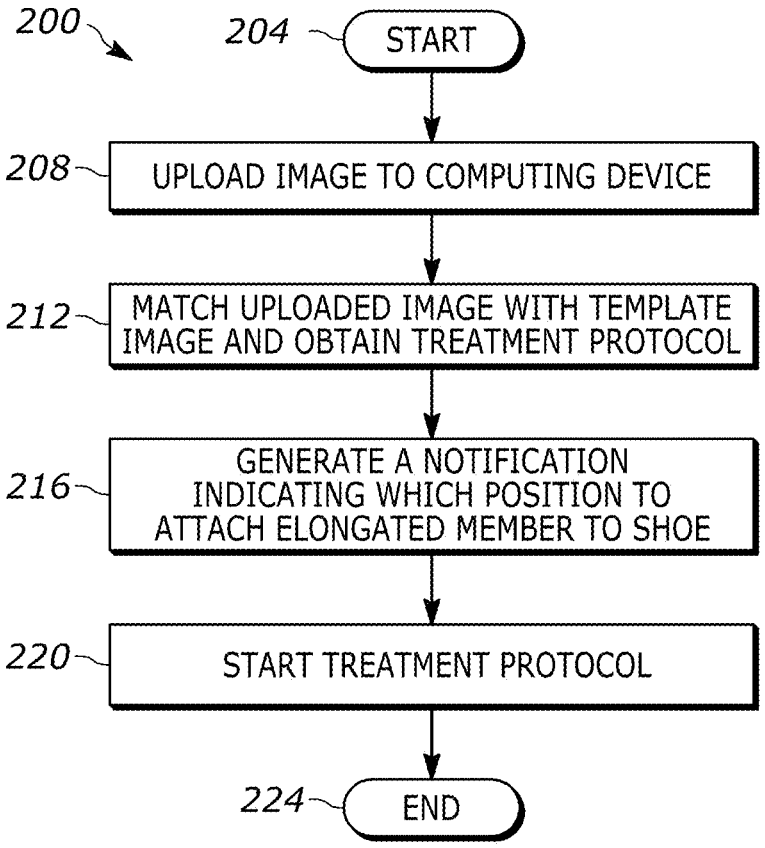
FIG. 6 is a flowchart depicting an algorithm for operating the exercise devices of the exercising apparatus.

With reference to FIG. 6, a flowchart 200 showing an example implementation of a control algorithm for oscillating at least one of the elongated members 26 of the exercise devices 20 to exercise and/or rehabilitate the lower body portion 13 of the user 12 is shown. The control algorithm begins at 204. At 208, the control algorithm, using the processor 68, uploads the medical image of the user 12 to the computing device 22.

At 212, the control algorithm, using the processor 68, matches the uploaded image to a corresponding template image that is stored in the memory unit 70 of the computing device 22 and obtains the treatment protocol associated with the corresponding template image. At 216, the control algorithm, using the processor 68, generates a notification indicating which position of the plurality of positions to attach the flexible elongated member 26 to the shoe 28. For example, the elongated member 26 may be attached to the shoe 28 in a first position in which the elongated member 26 and the shoe 28 are parallel to each other (i.e., the shoe 28 extends in a direction parallel to a longitudinal axis of the elongated member 26). In another example, the elongated member 26 may be attached to the shoe 28 in a second position in which the elongated member 26 is angled (i.e., non-parallel angle) relative to the shoe 28 (i.e., the portion of the elongated member 26 extends past the inward portion 34 of the shoe 28 at the front end thereof and the other portion of the elongated member 26 extends past the outward portion 36 of the shoe 28 at the rear end thereof).

Figure 7:
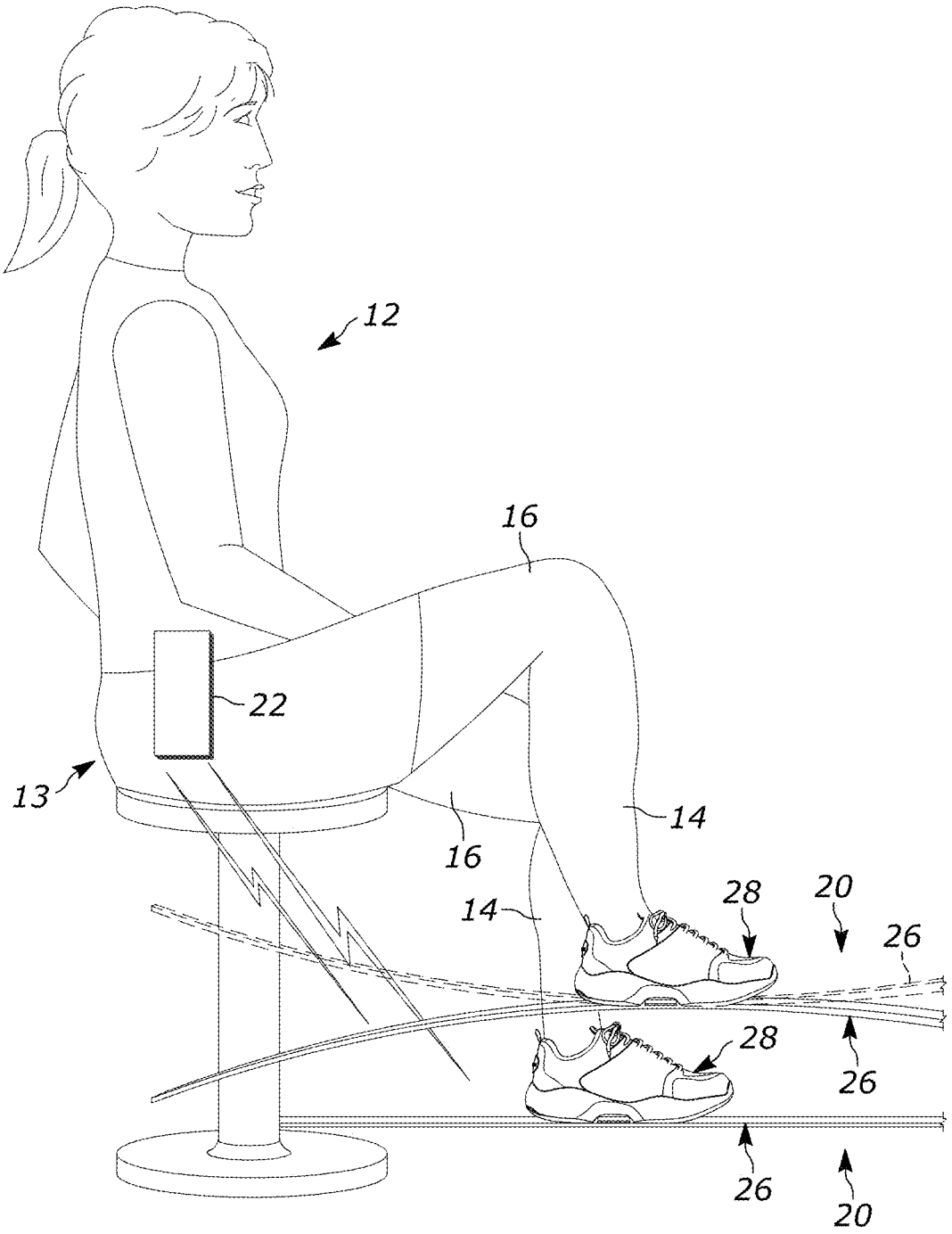
FIG. 7 is a perspective view of the person seated and wearing the exercising devices and an elongated member of one exercise device oscillating.

At 220, the control algorithm, using the processor 68, notifies the user 12 to start the treatment protocol. Once the user 12 starts the treatment protocol, the computing device 22 transmits a signal to the motor 62 to turn the motor 62 to the ON mode. Based on the treatment protocol, the signal transmitted to the motor 62 causes the motor 62 to turn ON for a predetermined duration and at a predetermined power. In some configurations, based on the treatment protocol, the signal transmitted to the motor 62 causes the power of the motor 62 to vary over the course of the predetermined duration. For example, if the motor 62 is to be turned to the ON mode for a predetermined duration of 10 minutes, the motor 62 may operate at a first power for 5 minutes and a second power for 5 minutes. The motor 62, when in the ON mode, moves the vibration members 64 up and down, which causes the elongated member 26 to oscillate (FIG. 7). The magnitude of the oscillations depends on the power that the motor 62 is operating at. Oscillation of the elongated member 26 exercises and/or rehabilitates the muscles in the lower body portion 13 of the user 12, for example. The control algorithm then proceeds to 224 and ends.

The teachings of the present disclosure provides the benefit of allowing the user 12 to exercise and/or rehab his or her lower body portion 13 without movement of his or her lower body portion 13. It should be understood that, in some configurations, the user 12 may manually move his or her legs up and down, for example, to cause oscillations of the elongated members 26, thereby exercising and/or rehabbing his or her lower body portion 13. The teachings of the present disclosure may also allow the user 12 to exercise and/or rehab at home as oppose to exercising and/or rehabbing at a gym or rehabilitation facility. The teachings of the present disclosure may also allow the user 12 to exercise and/or rehab different areas of his or her lower body portion 13 based on the treatment protocol (i.e., based on the position that the elongated member 26 is attached to the shoe 28 and based on the duration that the motor 62 is turned ON for and the power that the motor 62 is set at).

In another embodiment, with reference to FIGS. 9-12, the exercising apparatus 10 may include a shoe binding apparatus 100 on each elongated member 26 configured to attach the shoe 28 of the user 12 to the elongated member 26. For example, the shoe binding apparatuses 100 can be used in place of the fasteners 38*a*, 38*b* and apertures 40, 42 shown in FIG. 3. The shoe binding apparatus 100, for example, can include one or more attachment clamping mechanisms 102, 104, 106, 108 configured to open and close around the shoe 28 of the user 12 attaching and locking the shoe 28 of the user 12 to the elongated member 26. For example, a portion of each of the attachment clamping mechanisms 102, 104, 106, 108 is configured to pivot between an open position and a closed position, with the attachment clamping mechanisms 102, 104, 106, 108 securing the shoe 28 to the elongated member 26 when the portions of each of the attachment clamping mechanisms 102, 104, 106, 108 are in the closed positions. The attachment clamping mechanisms 102, 104, 106, 108 can be made of plastic or other suitable material for attaching and securing the shoe 28 to the elongated member 26.

Figure 9:
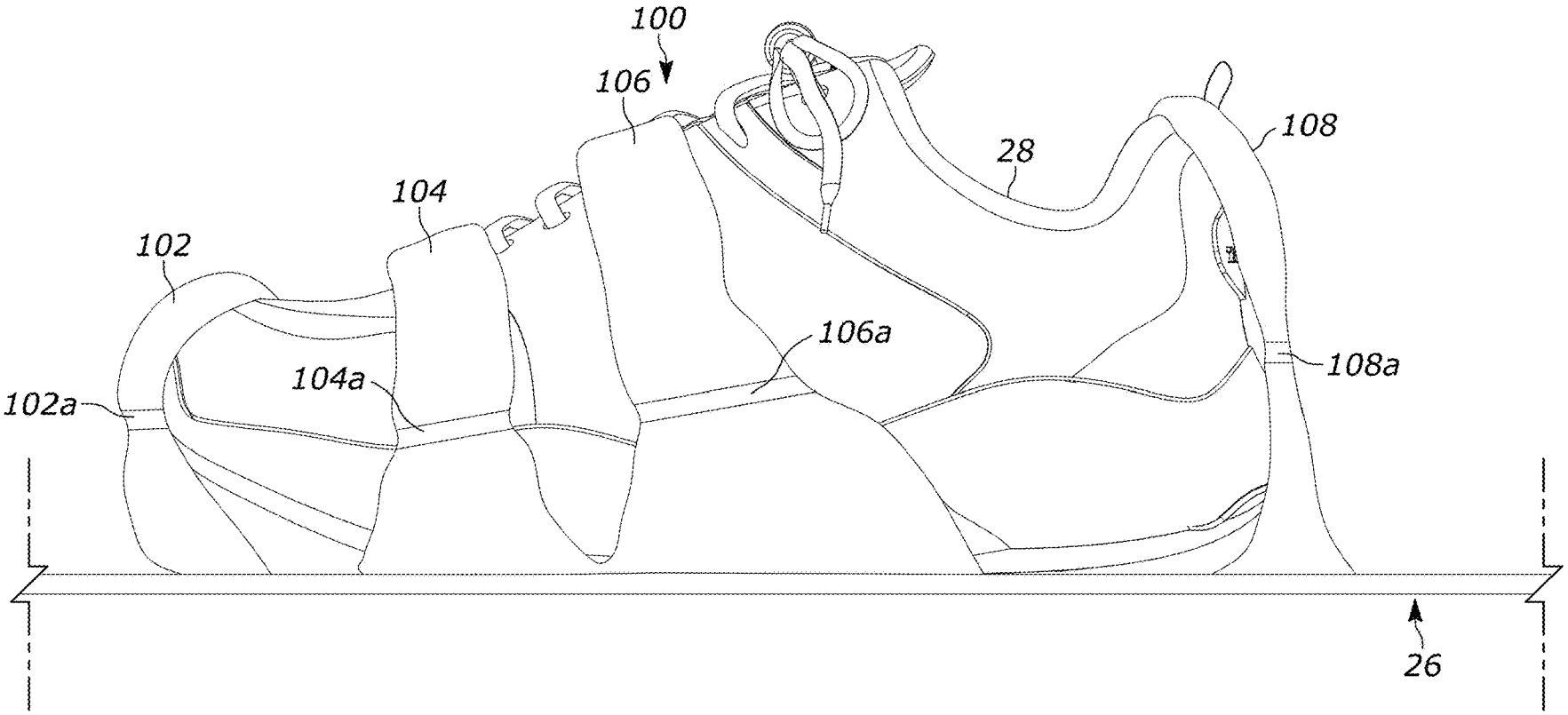
FIG. 9 is a side view of an exercise device with a shoe binding apparatus and a shoe.

With reference to FIG. 9, a side view of the shoe binding apparatus 100 is shown with the attachment clamping mechanisms 102, 104, 106, 108 in a closed position, locked down on the shoe 28 of the user 12 and securing the shoe 28 to the elongated member 26.

Figure 10:
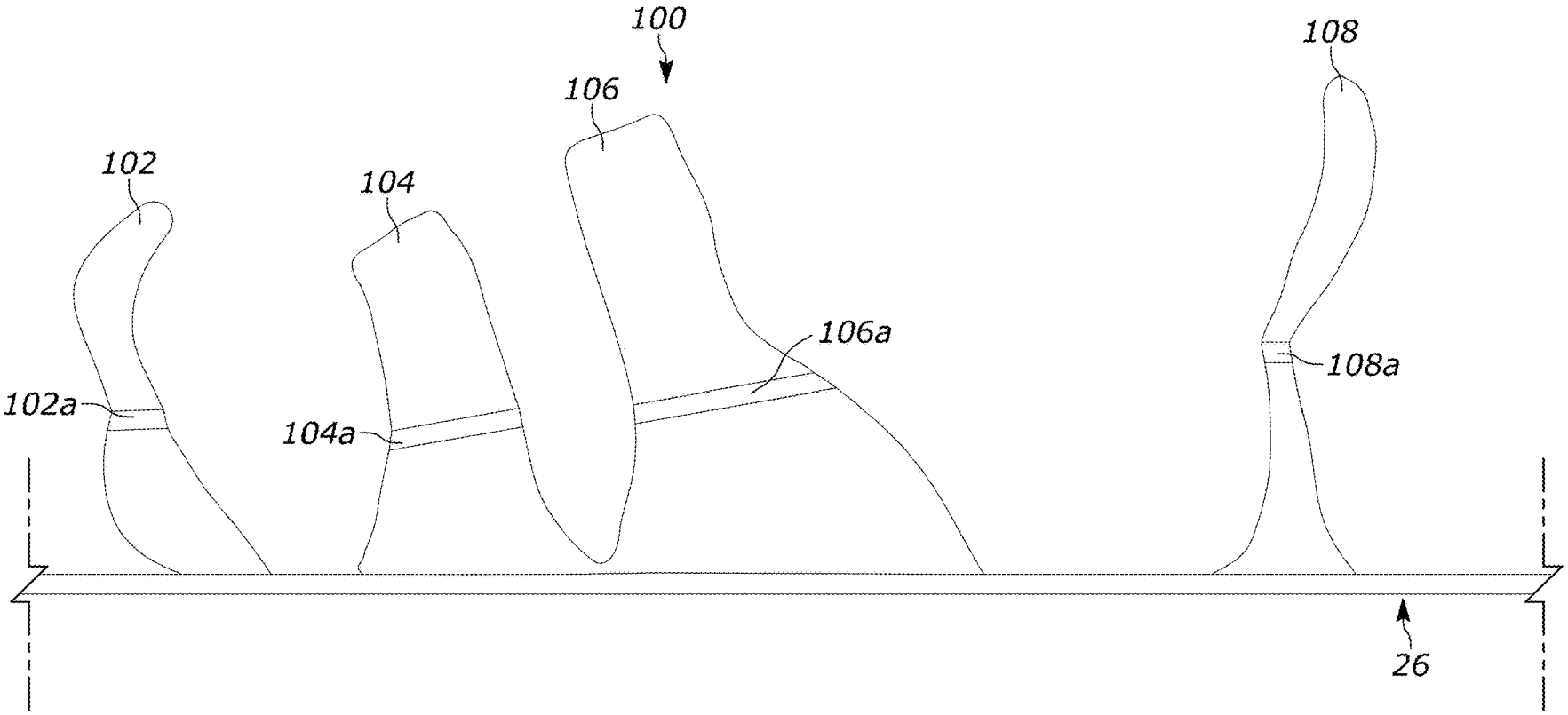
FIG. 10 is a side view of the exercise device of FIG. 9 with the shoe binding apparatus without the shoe.
Figure 11:
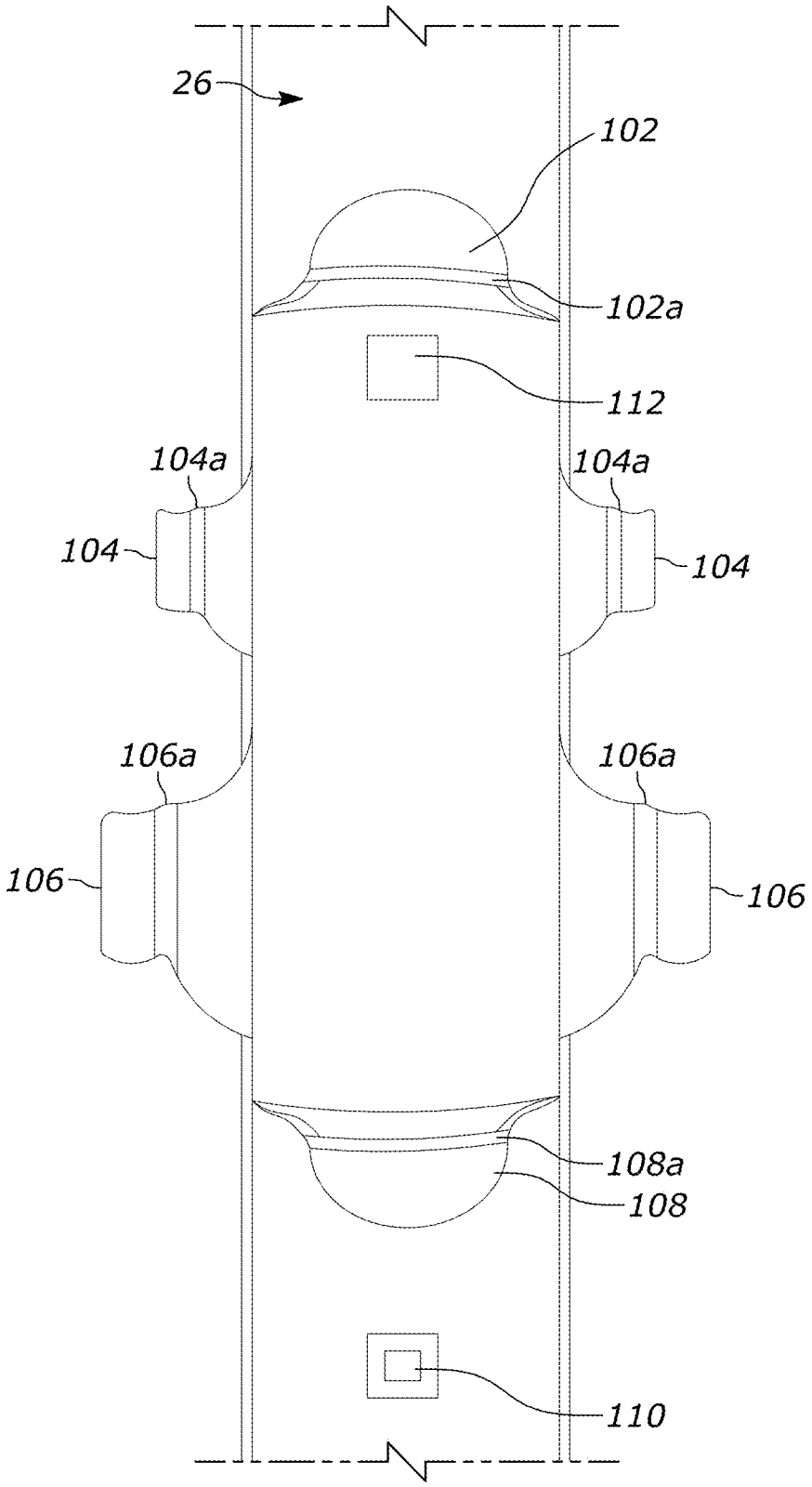
FIG. 11 is a top view of the exercise device of FIG. 9 with the shoe binding apparatus without the shoe.

With reference to FIG. 10, a side view of the shoe binding apparatus 100 is shown without a shoe 28 and with each of the attachment clamping mechanisms 102, 104, 106, 108 in an open position, ready to receive a shoe 28. Similarly, with reference to FIG. 11, a top view of the shoe binding apparatus 100 is shown without a shoe 28 and with each of the attachment clamping mechanisms 102, 104, 106, 108 in an open position, ready to receive a shoe 28.

Figure 12:
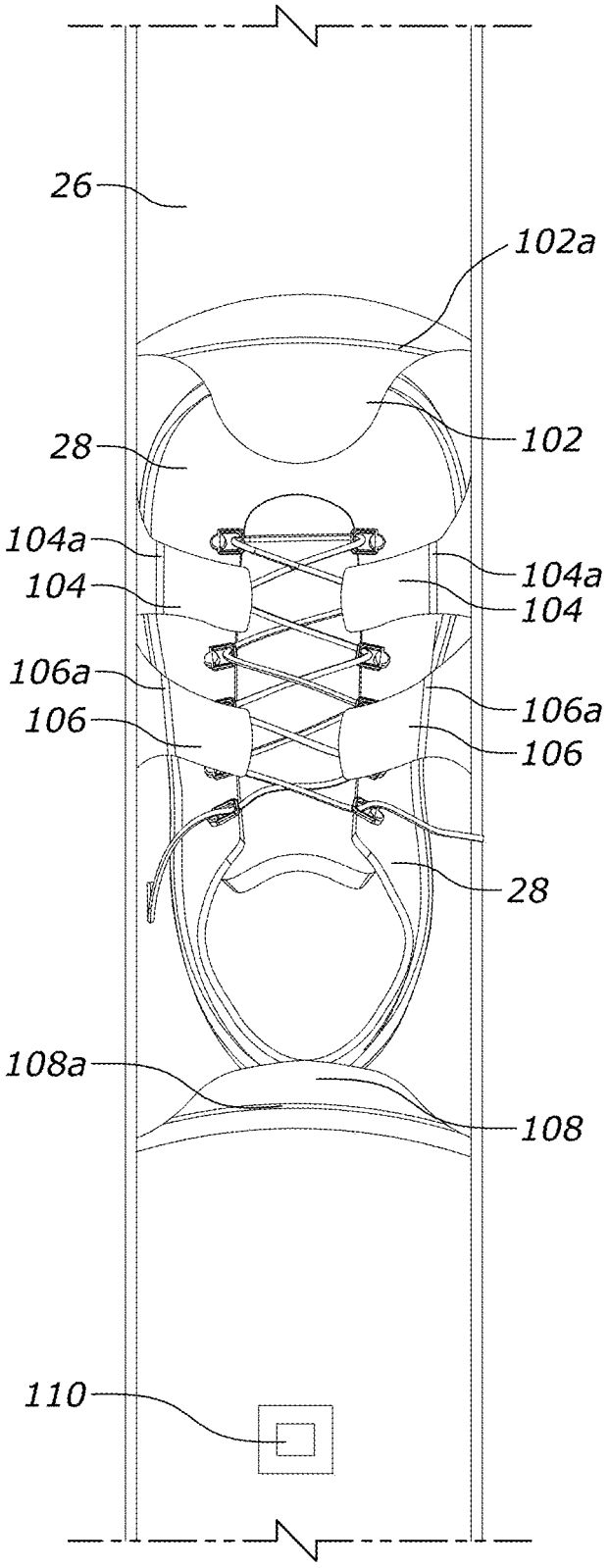
FIG. 12 is a top view of the exercise device of FIG. 9 with the shoe binding apparatus with the shoe.

With reference to FIG. 12, a top view of the shoe binding apparatus 100 is shown with the attachment clamping mechanisms 102, 104, 106, 108 in a closed position, locked down on the shoe 28 of the user 12 and securing the shoe 28 to the elongated member 26.

Each of the attachment clamping mechanisms 102, 104, 106, 108 may include a corresponding actuator 102*a*, 104*a*, 106*a*, 108*a* that operates to close the corresponding attachment clamping mechanisms 102, 104, 106, 108 and secure the shoe 28 to the elongated member 26. For example, the actuators 102*a*, 104*a*, 106*a*, 108*a* can include a spring loaded actuation device with a lock and release mechanism. In such case, the attachment clamping mechanisms 102, 104, 106, 108 can be manually rotated to an open and locked position. The actuators 102*a*, 104*a*, 106*a*, 108*a* can be connected to an actuator trigger 112 (shown in FIG. 11), such as a manual switch, that is triggered when the shoe 28 is placed in the shoe binding apparatus 100. For example, the actuator trigger 112 can be a manual button that is depressed by the user 12 when the user 12 pushes the shoe 28 into place within the shoe binding apparatus 100. The manual button of the actuator trigger 112, for example, can be mechanically linked to each of the actuators 102*a*, 104*a*, 106*a*, 108*a* such that actuation of the manual button causes the actuators 102*a*, 104*a*, 106*a*, 108*a* to close. Once depressed, the actuator trigger 112 can release each of the actuators 102*a*, 104*a*, 106*a*, 108*a* such that the actuators 102*a*, 104*a*, 106*a*, 108*a* drive the attachment clamping mechanisms 102, 104, 106, 108 into a close position to lock and secure the shoe 28 to the elongated member 26. A release button 110 (shown in FIGS. 11 and 12) can be used to trigger the actuators 102*a*, 104*a*, 106*a*, 108*a* to release the attachment clamping mechanisms 102, 104, 106, 108 so that the attachment clamping mechanisms 102, 104, 106, 108 can be opened and the shoe 28 can be removed from the shoe binding apparatus 100. For example, the release button 110 can be mechanically linked to each of the actuators 102*a*, 104*a*, 106*a*, 108*a* such that actuation of the manual button causes the actuators 102*a*, 104*a*, 106*a*, 108*a* to open.

Additionally or alternatively, the actuators 102*a*, 104*a*, 106*a*, 108*a* can be electrically operated actuators with one or more electrical motors, such as one or more stepper motors, that drive the pivotable portions of the attachment clamping mechanisms 102, 104, 106, 108 between the open and closed positions. In such case, the actuator trigger 112 can be a sensor, such as a proximity sensor, that senses when a shoe 28 is placed within the shoe binding apparatus 100 and communicates an actuation signal to the actuators 102*a*, 104*a*, 106*a*, 108*a* triggering the actuators 102*a*, 104*a*, 106*a*, 108*a* to drive the pivotable portions of the attachment clamping mechanisms 102, 104, 106, 108 to the closed position, securing the shoe 28 to the elongated member 26. Additionally or alternatively, the actuator trigger 112 can be a button that is depressed by the user 12 with the shoe 28. The actuator trigger 112 can be electrically connected to and in communication with each of the actuators 102*a*, 104*a*, 106*a*, 108*a* and can communicate the actuation signal to the actuators 102*a*, 104*a*, 106*a*, 108*a*. For example, in an embodiment where the actuator trigger 112 includes a proximity sensor, the actuator trigger can communicate the actuation signal to the actuators 102*a*, 104*a*, 106*a*, 108*a* when the proximity sensor senses that a shoe has entered the shoe binding apparatus 100. For further example, in an embodiment where the actuator trigger 112 includes a button, the actuator trigger 112 can communicate the actuation signal to the actuators 102*a*, 104*a*, 106*a*, 108*a* when the proximity sensor senses that a shoe has entered the shoe binding apparatus 100. Additionally, the release button 110 (shown in FIGS. 11 and 12) can be electrically connected to and in communication with each of the actuators 102*a*, 104*a*, 106*a*, 108*a* and can communicate a release signal to the actuators 102*a*, 104*a*, 106*a*, 108*a* to release the attachment clamping mechanisms 102, 104, 106, 108 by driving the electrical motors to open the attachment clamping mechanisms 102, 104, 106, 108 so that the shoe 28 can be removed from the shoe binding apparatus 100. For example, the release button 110 can be electrically connected to each of the actuators 102*a*, 104*a*, 106*a*, 108*a* such that actuation of the release button causes the actuators 102*a*, 104*a*, 106*a*, 108*a* to open.

Figure 13:
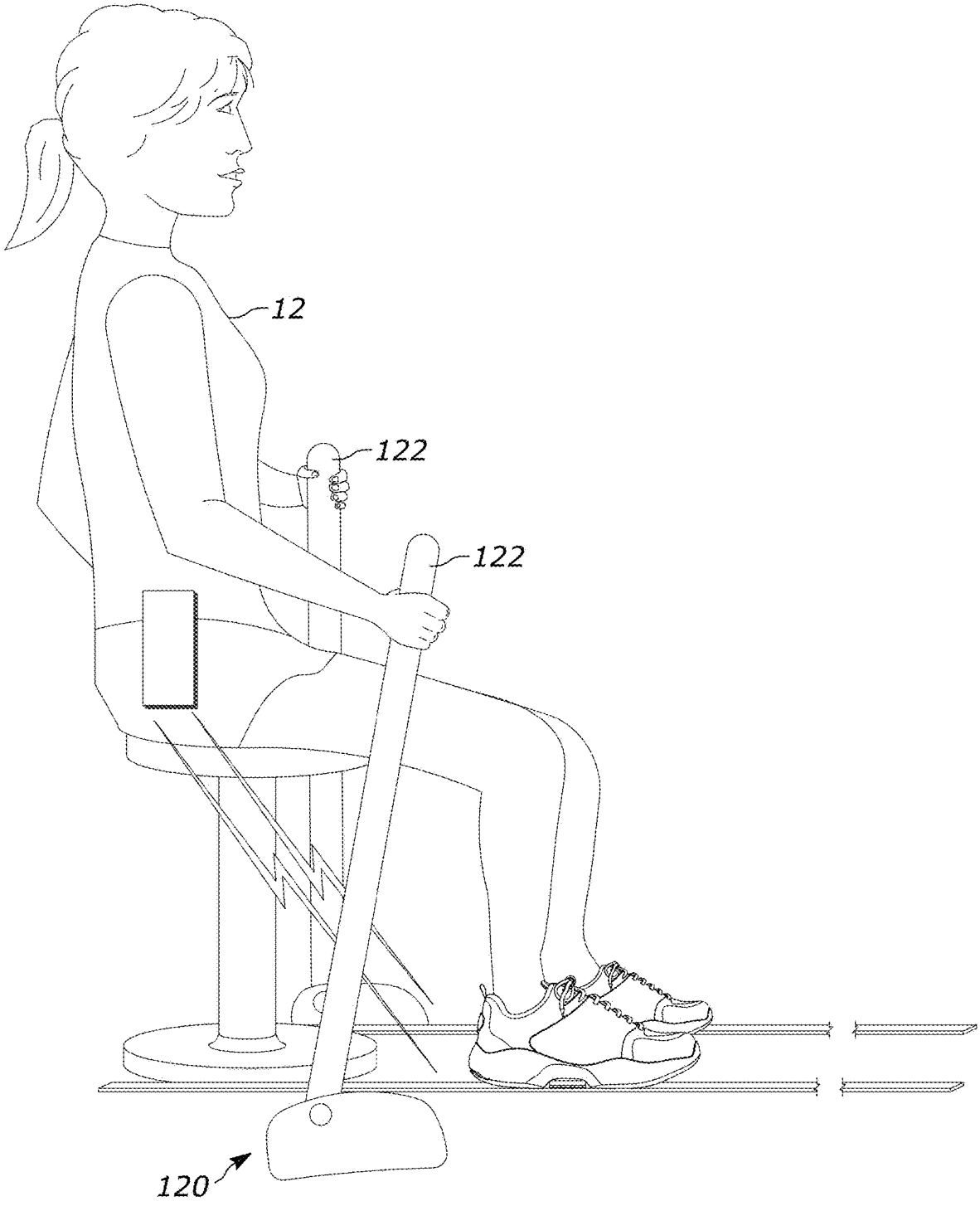
FIG. 13 is a perspective view of a person seated and wearing alternate exercising devices of an exercising apparatus also having arm exercising devices.

In another embodiment, with reference to FIG. 13, the exercising apparatus 10 may additionally include an arm exercising device 120 with poles having handles 122 that can be grasped and pivoted back and forth. The arm exercising device 120 can be used by the user 12 for support as the user 12 exercises the user's legs using the elongated members 26. Additionally, the arm exercising device 120 can include a resistance for moving the poles of the arm exercising device back and forth. In this way, the resistance can provide exercise for the user's arms as the user 12 pivots the poles back and forth via the handles 122, while the user is also exercising the user's legs using the elongated members 26.

Figure 14:
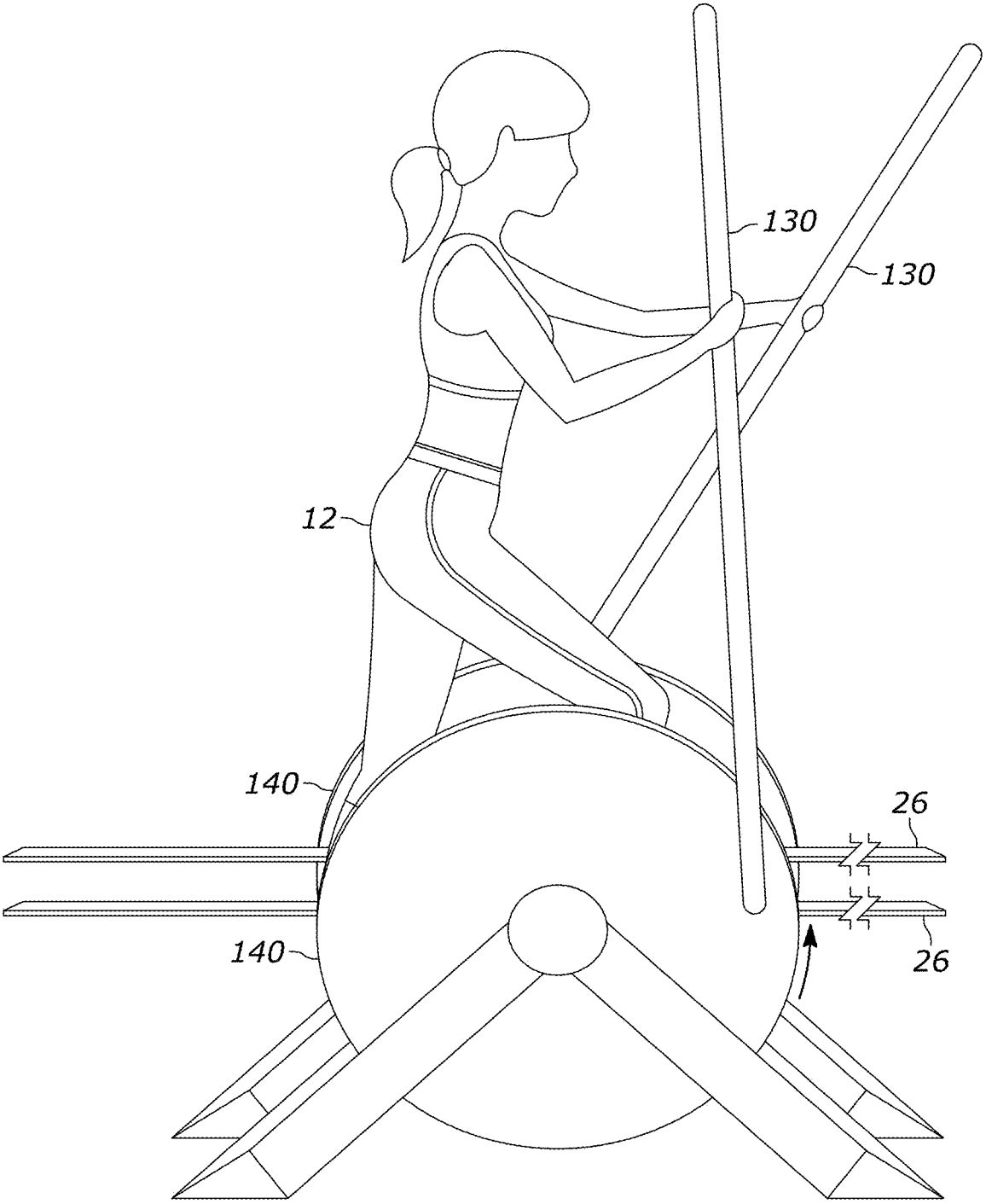
FIG. 14 is a perspective view of a person standing while wearing alternate exercising devices attached to rotational drums of an exercising apparatus also having arm exercising devices.

In another embodiment, with reference to FIG. 14, the exercising apparatus 10 may additionally include rotational drums 140 attached to the elongated members 26. Additionally, the exercising apparatus 10 may include poles 130 that are also attached to the rotational drums 140. The rotational drums 140 may interlocked to rotate at the same rotational speed. In addition, the rotational drums 140 may be attached to the elongated members 26 and to the poles 130 such that the location points are 180° out of phase. For example, when one of the elongated members 26 is at the highest rotational point, the other elongated member 26 is at the lowest rotational point. When one of the elongated members 26 is at the horizontally forward-most point in the rotation, the other elongated member 26 is at the horizontally rearward-most point in the rotation. Similarly, when the attachment point for one of the poles 130 is at the highest rotational point, the attachment point for the other pole 130 is at the lowest rotational point. When the attachment point for one of the poles 130 is at the horizontally forward-most point in the rotation, the other pole 130 is at the horizontally rearward-most point in the rotation.

Additionally, the poles 130 can each be configured with a motor assembly, similar to motor 62, and with vibration members, similar to vibration members 64, that cause the poles 130 to oscillate. For example, the motor and vibration members may be positioned within the interior of the poles 130, causing the poles to oscillate when operated. In this way, the oscillations of the poles 130 can provide exercise to the arms of the user 12, while the oscillations of the elongated members 26 can provide exercise to the legs of the user. In addition, the rotational motion of the rotational drums 140 can provide additional exercise to the legs of the user 12 due to the rotational cycling motion of the shoes of the user 12 while attached to the elongated members 26, which are in turn attached to the rotational drums 140. In addition, the rotational motion of the rotational drums 140 can provide additional exercise to the arms of the user 12 due to the back and forth motion of the arms of the user 12 as the user holds on to the poles 130 attached to the rotational drums 140.

In this application, including the definitions below, the term "module" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An exercise apparatus comprising:

a flexible elongated member;

a binding apparatus attached to the flexible elongated member and having at least one clamping mechanism configured to secure a shoe of a user of the exercise apparatus to the flexible elongated member; and a motor assembly disposed between the shoe and the flexible elongated member, the motor assembly configured to cause the flexible elongated member to oscillate.

2. The exercise apparatus of claim 1, wherein the at least one clamping mechanism is pivotable between an open position to receive or release the shoe and a closed position to secure the shoe to the flexible elongated member.

3. The exercise apparatus of claim 2, wherein the at least one clamping mechanism includes an actuator that drives the at least one clamping mechanism between the open and the closed position, the exercise apparatus further comprising an actuator trigger connected to the actuator, the actuator trigger being configured to trigger the actuator to drive the at least one clamping mechanism to the closed position.

4. The exercise apparatus of claim 3, wherein the actuator trigger includes a mechanical button.

5. The exercise apparatus of claim 3, wherein the actuator trigger includes a proximity sensor.

6. The exercise apparatus of claim 2, wherein the at least one clamping mechanism includes an actuator having a spring loaded actuation device configured to drive the at least one clamping mechanism between the open position and the closed position.

7. The exercise apparatus of claim 2, wherein the at least one clamping mechanism includes an actuator having an electrical motor configured to drive the at least one clamping mechanism between the open position and the closed position.

8. The exercise apparatus of claim 2, wherein the at least one clamping mechanism includes an actuator that drives the at least one clamping mechanism between the open and the closed position, the exercise apparatus further comprising a release button connected to the actuator, the release button being configured to trigger the actuator to drive the at least one clamping mechanism to the open position.

9. The exercise apparatus of claim 1, wherein the motor assembly includes a motor and a plurality of vibration members connected to the motor, and wherein the plurality of vibration members are spaced apart from a top surface of the flexible elongated member when the motor is in an OFF mode.

10. The exercise apparatus of claim 9, wherein the plurality of vibration members are configured to move up and down when the motor is turned to an ON mode, which causes the plurality of vibration members to impact the top surface of the flexible elongated member such that the flexible elongated member oscillates.

11. The exercise apparatus of claim 1, further comprising an arm exercising device with poles configured to be moved back and forth by the user of the exercise apparatus.

12. The exercise apparatus of claim 11, wherein the arm exercising device is configured to provide a resistance to movement of the poles back and forth by the user.

13. A method comprising:

securing a shoe of a user of an exercise apparatus to a flexible elongated member with a binding apparatus attached to the flexible elongated member and the binding apparatus having at least one clamping mechanism configured to secure the shoe of the user to the flexible elongated member; and oscillating the flexible elongated member with a motor assembly disposed between the shoe and the flexible elongated member.

14. The method of claim 13, wherein the at least one clamping mechanism is pivotable between an open position to receive or release the shoe and a closed position to secure the shoe to the flexible elongated member.

15. The method of claim 14, wherein the at least one clamping mechanism includes an actuator that drives the at least one clamping mechanism between the open and the closed position, the exercise apparatus further comprising an actuator trigger connected to the actuator, the actuator trigger being configured to trigger the actuator to drive the at least one clamping mechanism to the closed position.

16. The method of claim 15, wherein the actuator trigger includes a mechanical button.

17. The method of claim 15, wherein the actuator trigger includes a proximity sensor.

18. The method of claim 14, wherein the at least one clamping mechanism includes an actuator having a spring loaded actuation device configured to drive the at least one clamping mechanism between the open position and the closed position.

19. The method of claim 14, wherein the at least one clamping mechanism includes an actuator having an electrical motor configured to drive the at least one clamping mechanism between the open position and the closed position.

20. The method of claim 14, wherein the at least one clamping mechanism includes an actuator that drives the at least one clamping mechanism between the open and the closed position, the exercise apparatus further comprising a release button connected to the actuator, the release button being configured to trigger the actuator to drive the at least one clamping mechanism to the open position.

21. The method of claim 13, wherein the motor assembly includes a motor and a plurality of vibration members connected to the motor, and wherein the plurality of vibration members are spaced apart from a top surface of the flexible elongated member when the motor is in an OFF mode.

22. The method of claim 21, wherein the plurality of vibration members are configured to move up and down when the motor is turned to an ON mode, which causes the plurality of vibration members to impact the top surface of the flexible elongated member such that the flexible elongated member oscillates.

23. The method of claim 13, further comprising moving an arm exercising device with poles back and forth.

24. The method of claim 23, wherein the arm exercising device is configured to provide a resistance to movement of the poles back and forth by the user.

* * * * *